US006527592B2

(12) United States Patent
Mochizuki et al.

(10) Patent No.: US 6,527,592 B2
(45) **Date of Patent: *Mar. 4, 2003**

(54) MATCHING MALE AND FEMALE CONNECTOR ASSEMBLY

(75) Inventors: Shoichi Mochizuki, Yamanashi (JP); Shinichi Ikemoto, Tokyo (JP)

(73) Assignee: Kel Corporation Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/372,027

(22) Filed: Aug. 11, 1999

(65) Prior Publication Data

US 2002/0002015 A1 Jan. 3, 2002

(30) Foreign Application Priority Data

Aug. 28, 1998 (JP) ..... 10-242689

(51) Int. Cl.[7] ..... H01R 24/00
(52) U.S. Cl. ..... 439/660; 744/874
(58) Field of Search ..... 439/676, 660, 439/744, 357, 79, 492, 494, 497, 499, 579, 607, 874, 610

(56) References Cited

U.S. PATENT DOCUMENTS 4,826,443 A * 5/1989 Lockard ..... 439/610 X
5,000,695 A * 3/1991 Nishiyama et al. ..... 439/276
5,267,881 A * 12/1993 Matuzaki ..... 439/660
5,364,292 A * 11/1994 Bethurum ..... 439/610
5,476,396 A * 12/1995 De Castro ..... 439/692
5,658,170 A * 8/1997 Tan et al. ..... 439/610
5,993,256 A * 11/1999 Shimojyo ..... 439/604

* cited by examiner

*Primary Examiner*—Brian Sircus
*Assistant Examiner*—Son V. Nguyen
(74) *Attorney, Agent, or Firm*—Robert W.J. Usher

(57) ABSTRACT

A receptacle connector (R) comprises a plurality of receptacle contacts (70), each of which has a female contact portion (71) in a tuning-fork like shape, and a receptacle retaining member (60), which aligns and retains the receptacle contacts (70). A plug connector (P) comprises a plurality of plug contacts (40), each of which has a male contact portion (41) insertable into the female contact portion (71) and a plug retaining member (10), which aligns and retains the plug contacts (40). The plug and receptacle connectors (P) and (R) are matable and constitute a matching male and female connector assembly. The plug retaining member (10) includes a reinforcing member (12) which extends along a side fo the male contact portions (41) of the plug contacts (40) retained therein. While the plug and receptacle connectors (P) and (R) are being brought into engagement with each opther for electrical connection, the male contact portions (41) along with the reinforcing member (12) are inserted as one body into the female contact portions (71).

2 Claims, 13 Drawing Sheets

MATCHING MALE AND FEMALE CONNECTOR ASSEMBLY

FIELD OF THE INVENTION

The present invention generally relates to an electrical connector assembly which comprises intermatable male and female connectors such as plug and receptacle connectors, and more particularly to a matching male and female connector assembly which has characteristic fitting parts for the contacts of the male and female connectors.

BACKGROUND OF THE INVENTION

Generally, an electrical connector assembly comprises a plug connector (male connector) and a receptacle connector (female connector), which constitute a matching male and female connector assembly. Each of the male and female connectors includes a plurality of contacts, which are aligned and retained in an electrically insulative retaining member. When the male and female connectors are mated with each other, the contacts of one connector are brought into contact with those of the other connector, respectively, for electrical connection.

For example, a construction which enables the connection of the contacts of matable connectors in the above mentioned way is shown in FIG. 18. This matching male and female connector assembly comprises a first and second connectors 201 and 211. The first connector 201 includes a plurality of first contacts 202, which are aligned and retained in a first retaining member 203, while the second connector 211 includes a plurality of second contacts 212, which are aligned and retained in a second retaining member 213. In this connector assembly, when the two retaining members are mated with each other, the second contact portions 212*a*, which are located at the front ends of the second contacts 212, are inserted into the space between the first contact portions 202*a*, which are located at the front ends of the first contacts 202, and a side wall 203*a* of the first retaining member 203 to bring the second contacts 212 into contact with the first contacts 202 for electrical connection.

Recently, connectors have undergone miniaturization and multi-terminalization, and the size and the alignment pitch of the contacts have been reduced to match the miniaturization and the multi-terminalization. Therefore, in the above mentioned prior-art matching male and female connector assembly, there is a concern that the second contact portions 212*a*, which are thin pins and are located at the front ends of the second contacts 212, may be deformed by a lateral force when the second contact portions 212*a* are brought into contact with the first contact portions 202*a* of the first contacts 202. This concern becomes a serious problem as the contacts are miniaturized progressively.

In this connector assembly, the first connector 201 gains the contact pressure necessary for secure electrical connection by holding the second contact portions 212*a* between the first contact portions 202*a* and the side wall 203*a* of the first retaining member 203. If the miniaturization of the connector assembly progresses, the side wall 203*a* of the first connector 201 will become thinner, eventually presenting a shortage of strength.

SUMMARY OF THE INVENTION

It is an object of the present invention to provide a matching male and female connector assembly which has a strength to provide the contacts with a sufficient contact pressure necessary for secure electrical connection without any adverse deformation of the contact portions even in a connector which has been miniaturized with a substantially narrow contact alignment pitch.

A matching male and female connector assembly according to the present invention comprises a first connector (e.g., the receptacle connector R described in the following embodiment) and a second connector (e.g., the plug connector P described in the following embodiment). The first connector includes a plurality of first contacts (e.g., the receptacle contacts 70 described in the following embodiment) and a first retaining member (e.g., the receptacle retaining member 60 described in the following embodiment) made of an electrically insulative material. The second connector includes a plurality of second contacts (e.g., the plug contacts 40 described in the following embodiment) and a second retaining member (e.g., the plug retaining member 10 described in the following embodiment) made of an electrically insulative material. The first retaining member aligns and retains the first contacts, each of which has a female contact portion in a tuning fork-like shape. The second retaining member aligns and retains the second contacts, each of which has a male contact portion, which is brought into contact with a corresponding female contact portion by insertion of the male contact portion into the tuning fork-like female contact portion. In this matching male and female connector assembly, the first connector and the second connector are engaged with each other for electrical connection through the insertion of the male contact portions into the female contact portions, respectively. Therefore, the second retaining member includes a reinforcing member (e.g., the plug extrusion 12 described in the following embodiment) which extends along a side of the male contact portions of the second contacts retained in the second retaining member. Thus, while the first connector and the second connector are being brought into engagement with each other, the male contact portions along with the reinforcing member are inserted as a one body into the female contact portions to bring the male contact portions into contact with the female contact portions for electrical connection of the first contacts and the second contacts.

In the first connector of this matching male and female connector assembly, the female contact portions, which are formed in a tuning fork-like shape, are made of a metallic plate to have a relatively high strength for holding the male contact portions, which are inserted therein. Because the male contact portions are held by the female contact portions, the first retaining member, which is molded of a resin with a relatively small strength, is not used for the purpose of holding the male contact portions. Therefore, even if the miniaturization of the connector assembly progresses, and the side wall of the first retaining member becomes thinner, there will be no problem of insufficient strength. Moreover, there will be no deformation of the second contacts even though they are made relatively thin with a narrow alignment pitch in correspondence with the miniaturization and the multi-terminalization of the connector assembly because the male contact portions, which are strengthened and supported by the reinforcing member in the second connector, are inserted as a one body with the reinforcing member into the female contact portions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
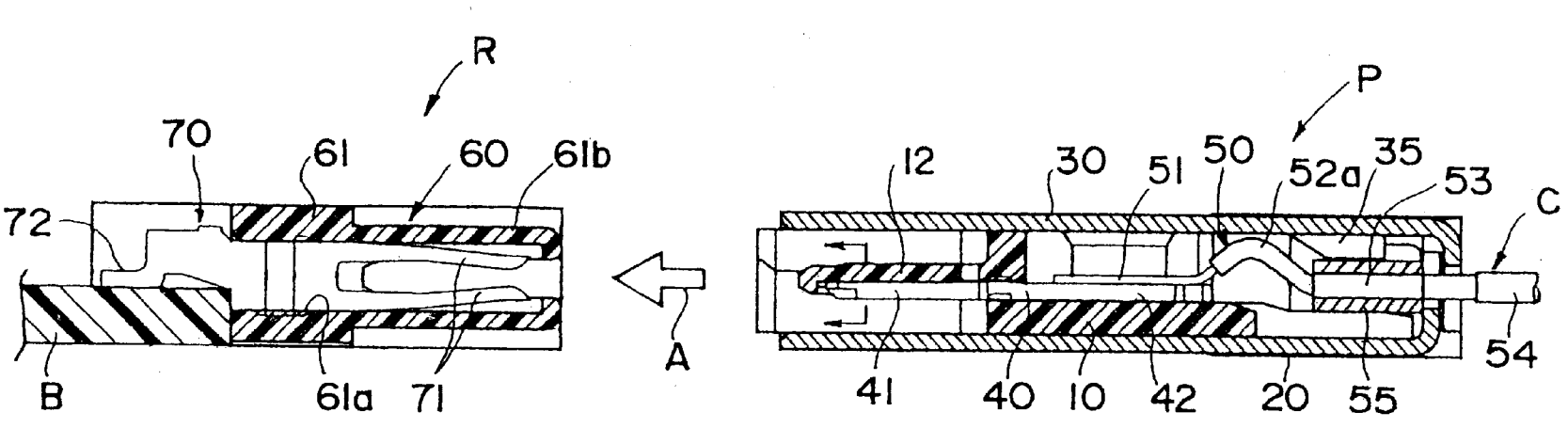
FIG. 1 shows a sectional view of a plug connector and a receptacle connector, which constitute a matching male and female connector assembly according to the present invention, taken along line I—I in FIG. 2 and also line I—I in FIG. 15.
Figure 2:
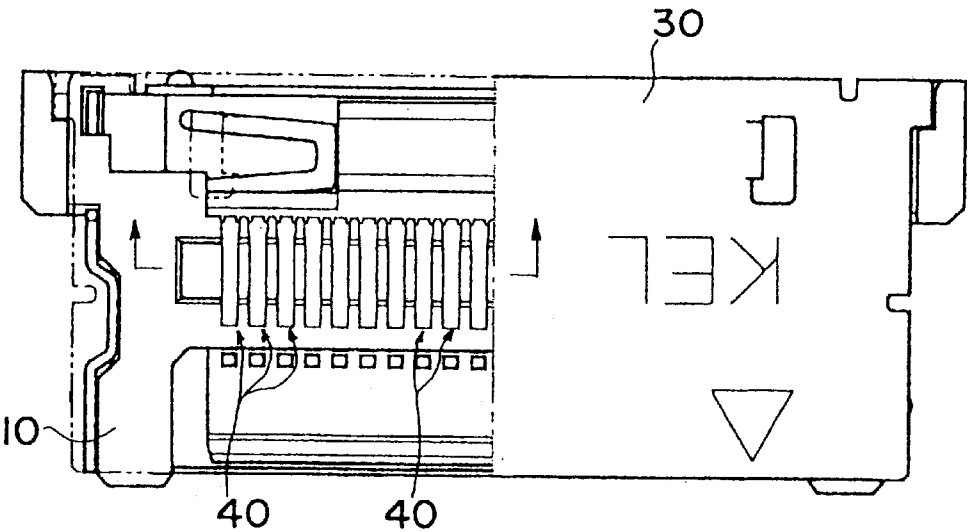
FIG. 2 shows a partially cut away plan view and a front view of the plug connector.
Figure 2:
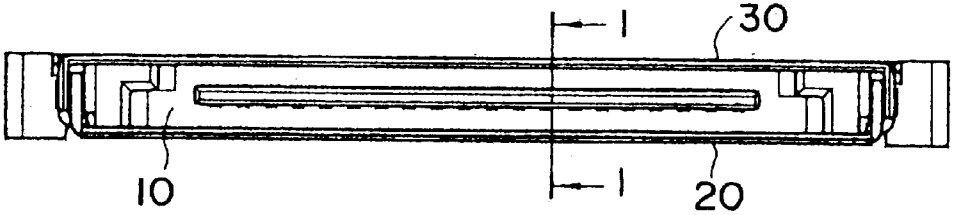
Figure 15:
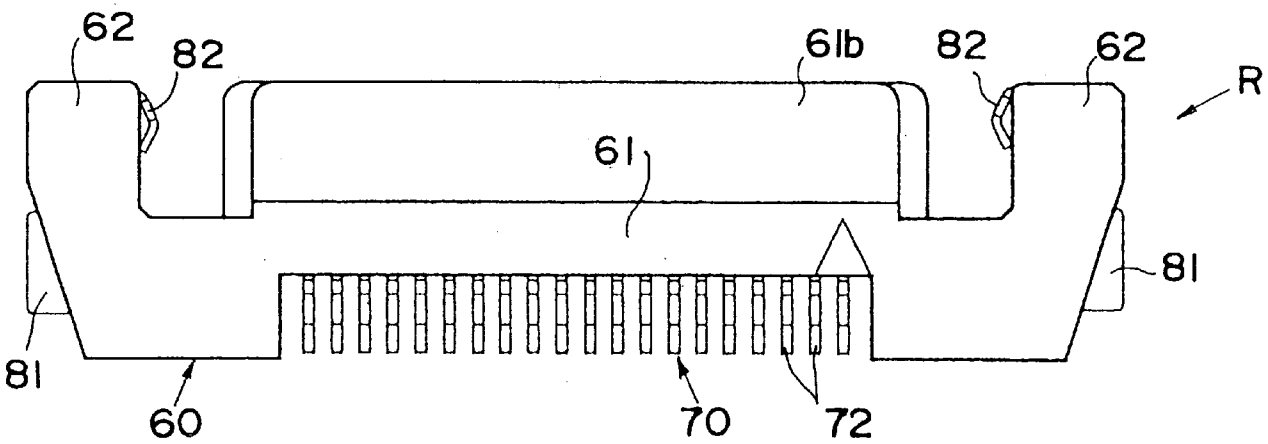
FIG. 15 shows a plan view and a front view of the receptacle connector.
Figure 15:
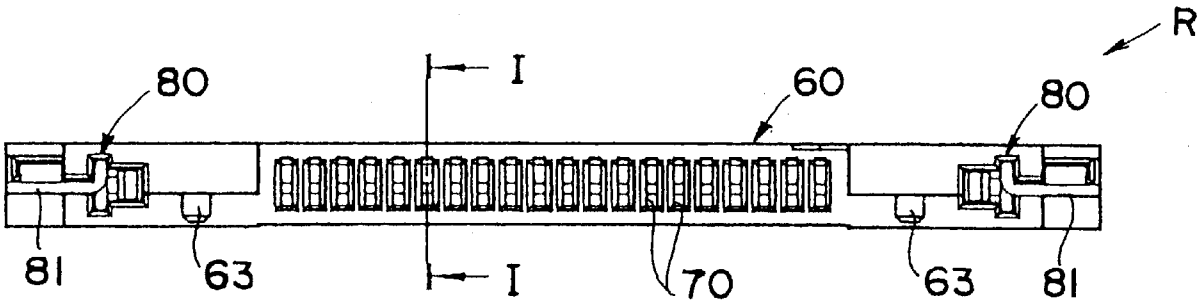
Figure 16:
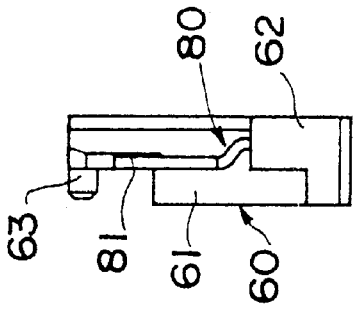
FIG. 16 shows a bottom view, a back view and a side view of the receptacle connector.
Figure 16:
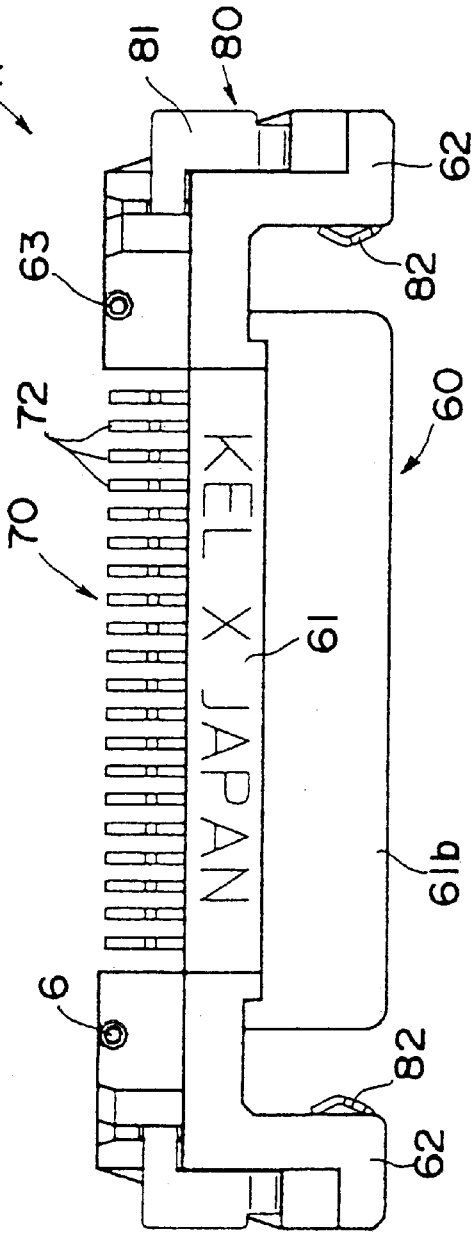
Figure 16:
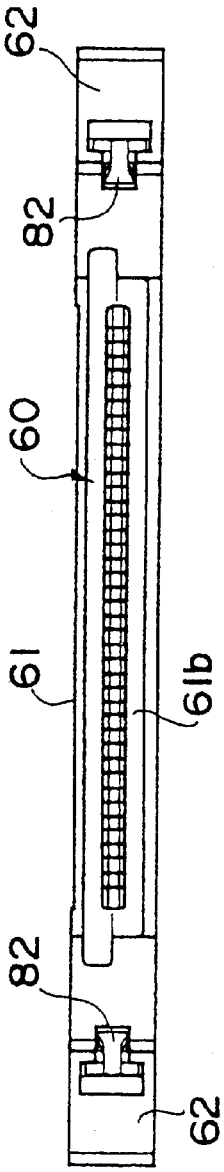

FIG. 1 shows an embodiment of matching male and female connector assembly according to the present invention. This matching male and female connector assembly comprises a plug connector P and a receptacle connector R, which are matable with each other. Also, FIG. 2 shows the plug connector P, and FIGS. 15 and 16 show the receptacle connector R. FIG. 1 is a cross-sectional view taken along line I—I in FIG. 2 and also along line I—I in FIG. 15.

The plug connector P comprises metallic lower and upper covers 20 and 30, a plug retaining member 10, which is formed of an electrically insulative resin and placed between the two covers 20 and 30, a plurality of plug contacts 40, which are aligned to one another on a plane and retained in the plug retaining member 10, and a cable assembly C, whose cables are soldered to the plug contacts 40 respectively and extend outward from the rear end of the plug contacts 40.

Figure 3:
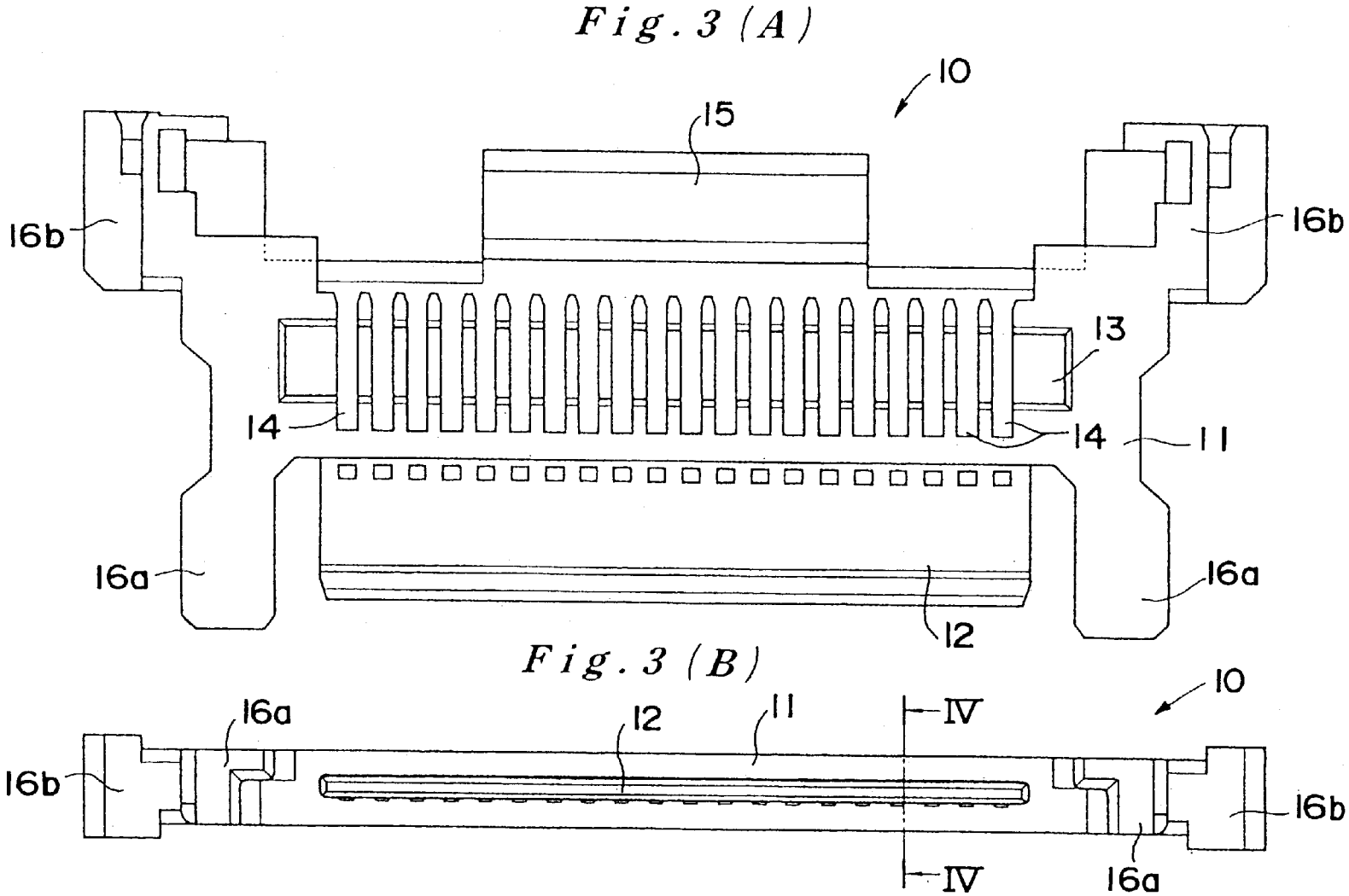
FIG. 3 shows a plan view and a front view of a retaining member of the plug connector (referred to as "plug retaining member")
Figure 4:
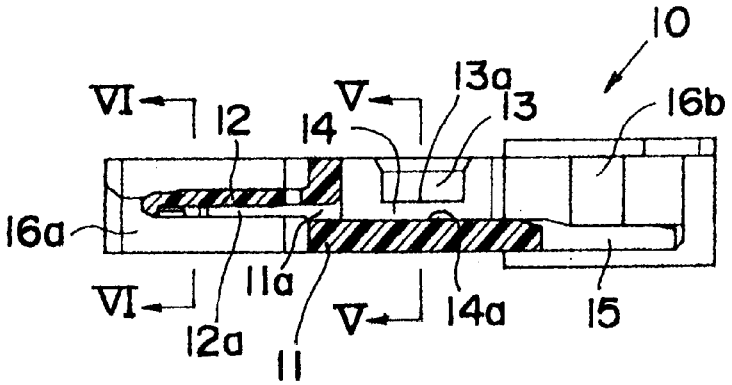
FIG. 4 shows a sectional view of the plug retaining member, taken along line IV—IV in FIG. 3.

The plug retaining member 10 is formed by molding as a one body including a main body 11, right and left front protrusions 16*a*, each of which extends forward from a front end on the lateral sides, and right and left rear protrusions 16*b*, each of which extends backward from a rear end on the lateral sides as shown in FIGS. 3 and 4. In addition, the plug retaining member 10 is formed with a plate-like plug extrusion 12, which extends forward from the main body 11 between the right and left front protrusions 16*a*, and with a central extrusion 15, which extends backward from the lower central portion of the main body 11 between the right and left rear protrusions 16*b*.

Figure 5:
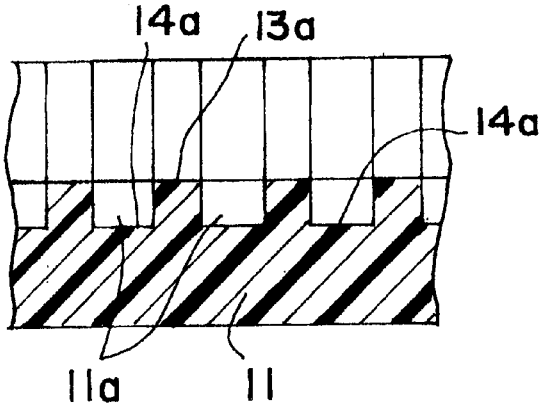
FIG. 5 shows a sectional view of the plug retaining member, taken along line V—V in FIG. 4.
Figure 6:
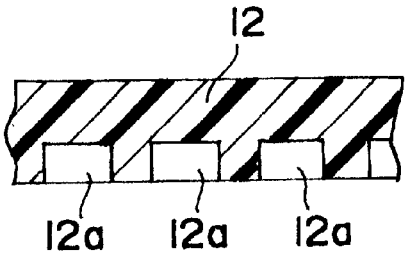
FIG. 6 shows a sectional view of the plug retaining member, taken along line VI—VI in FIG. 4.

A central groove 13 is provided extending laterally in the upper face of the main body 11, and a plurality of slots 14 are provided extending axially (i.e., in the direction of the axis of symmetry) across the central groove 13. FIG. 5 shows a sectional view of this part of the main body 11, taken along line V—V in FIG. 4. The plurality of slots 14 are deeper than the central groove 13, and the slot bottoms 14*a* of the slots 14 are positioned below the groove bottom 13*a* of the central groove 13. Therefore, in the central groove 13, the groove bottom 13*a* is the surface from which the slots 14 are guttered. Furthermore, the slot bottoms 14*a* are continuous to the bottom surfaces of through-holes 11*a* which are provided passing through the main body 11 to the plug extrusion 12. As shown in FIG. 6, which is a sectional view taken along line VI—VI in FIG. 4, the through-holes 11*a* are continuous to slots 12*a*, respectively, which are provided in the lower side of the plug extrusion 12.

Figure 11:
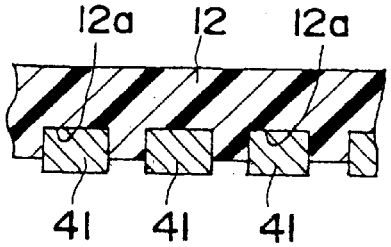
FIG. 11 shows a sectional view taken along line XI—XI in FIG. 9.

It is clear from the drawing that the slots 14, the through-holes 11*a* and the slots 12*a* are continuous, respectively, in the axial direction, and these axially continuous slots, which are used for insertion of electrical contacts (each slot is referred to as "contact insertion slot"), are aligned laterally. Each of the plug contacts 40 is press-fit from the rear of the main body 11 into a respective contact insertion slot, so a male contact portion 41, which is the front end portion of each plug contact 40, is received and retained in a respective slot 12*a* while a connection portion 42, which is the rear end portion of each plug contact 40, is received and retained in a respective slot 14 (for example, refer to FIGS. 1 and 9). As shown in FIG. 11, the male contact portions 41 are received and retained in the slots 12*a* of the plug extrusion 12, so the plug extrusion 12 serves to support and reinforce the male contact portions 41.

Figure 7:
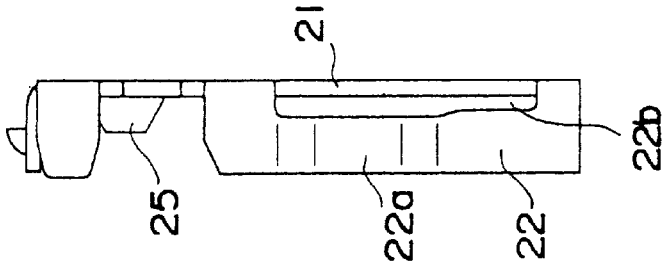
FIG. 7 shows a plan view, a front view and a side view of a lower cover.
Figure 7:
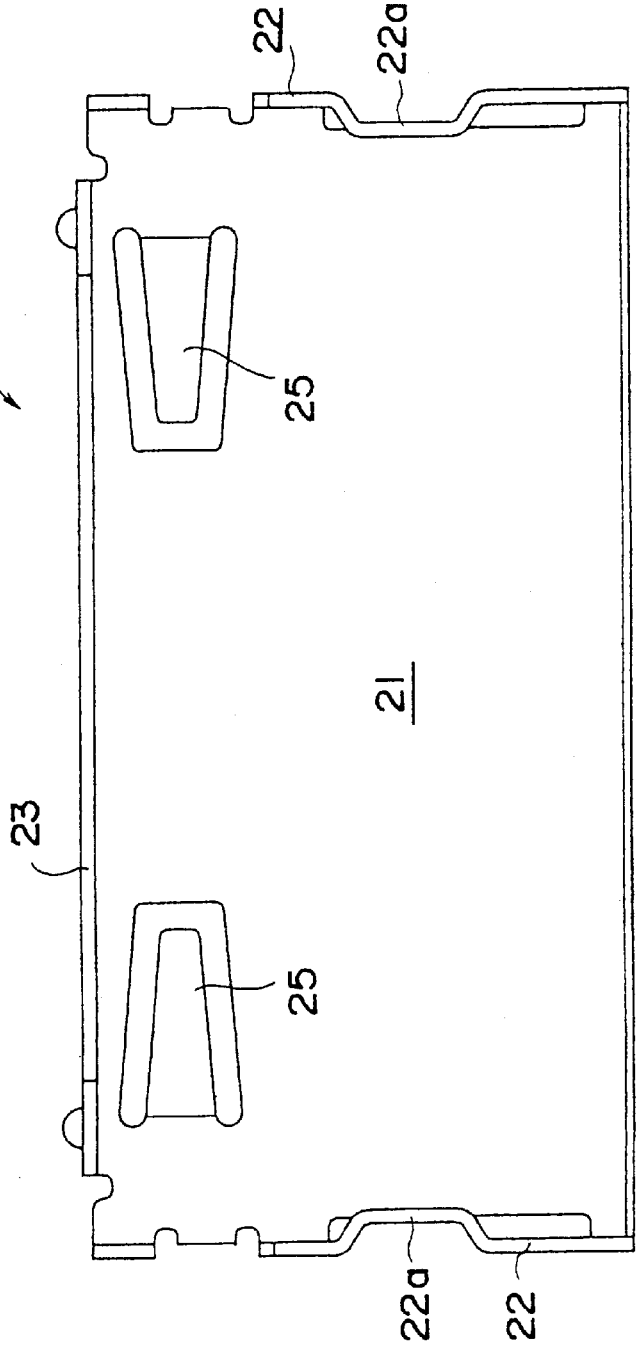
Figure 7:
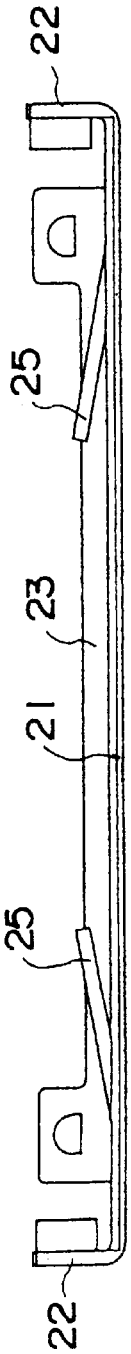
Figure 8:
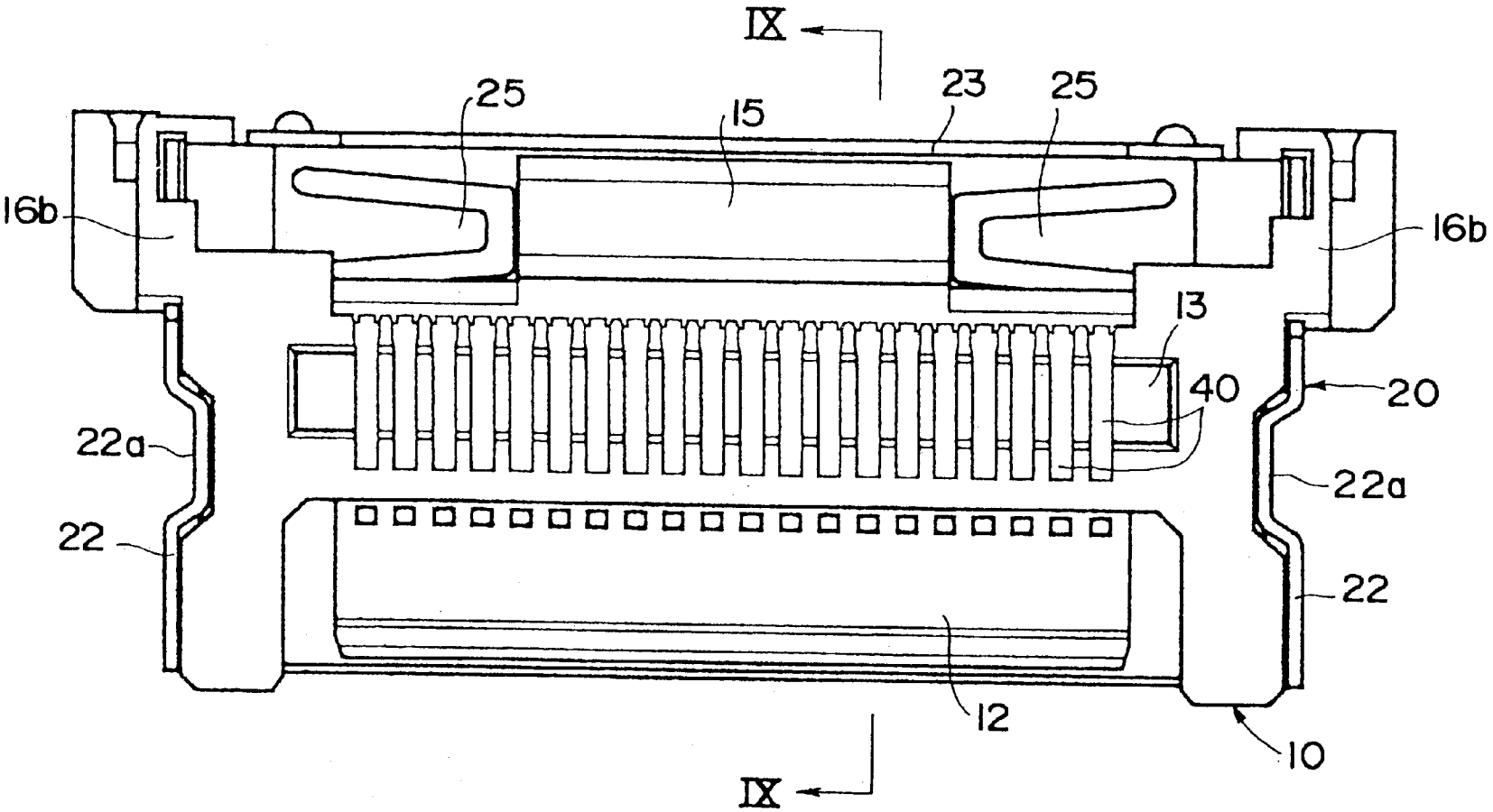
FIG. 8 shows a plan view showing the plug retaining member being mounted in the lower cover.

As shown in FIG. 8, this plug retaining member 10 (i.e., the plug retaining member 10 with the plug contacts 40 press-fit therein) is then mounted in the lower cover 20, which is also shown in detail in FIG. 7. The lower cover 20 comprises a rectangular flat bottom portion 21, lateral side walls 22 and a rear wall 23, each of which is bent upward from the bottom portion 21. Each lateral side wall 22 includes a concave portion 22*a*, which is recessed inward, and an engagement slot 22*b*, which extends axially on the lower side. When the plug retaining member 10 is being mounted into the cover, the plug retaining member 10 fits to the lateral side walls 22 and the rear wall 23 because each side of the plug retaining member 10 meets a respective concave portion 22*a*, which functions as a positioning guide.

The bottom portion 21 includes a lateral pair of contact tabs 25, which are formed by incising the rear part of the bottom portion 21 on the right and left sides and by bending the incised portions upward as shown in FIG. 7. When the plug retaining member 10 is mounted in the lower cover 20, each of the contact tabs 25 is positioned between the central extrusion 15 and the right or left rear protrusion 16*b* of the plug retaining member 10 as shown in FIG. 8, and the ends of the contact tabs 25 are above the upper surface of the central extrusion 15. The front of the lower cover 20 is open, so the plug extrusion 12 are exposed forward.

Figure 9:
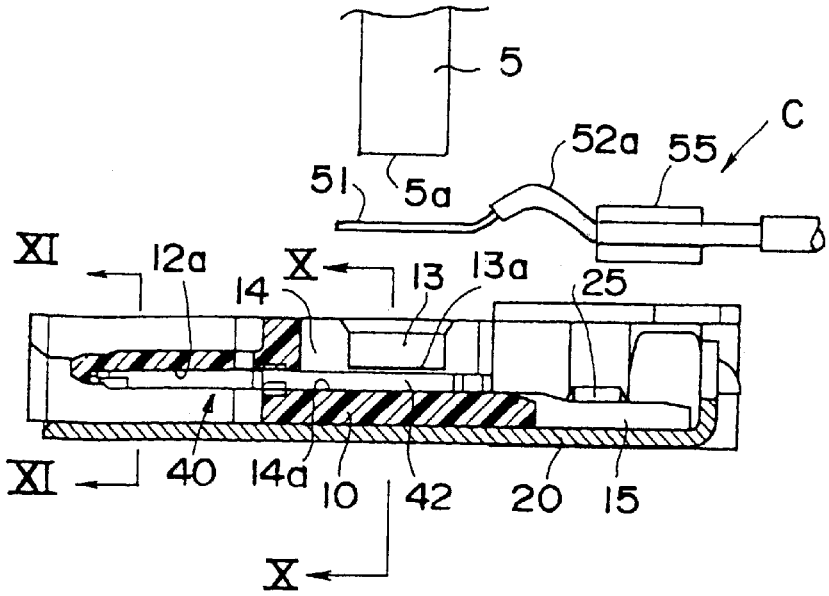
FIG. 9 shows a sectional view taken along line IX—IX in FIG. 8.
Figure 12:
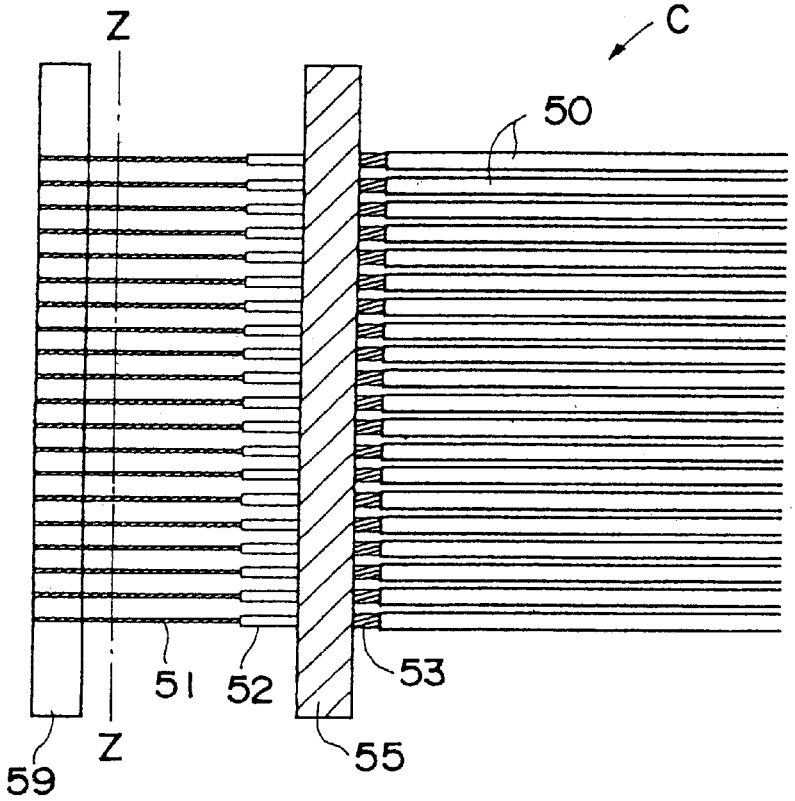
FIG. 12 shows a plan view, a front view and a side view of a cable assembly.
Figure 12:
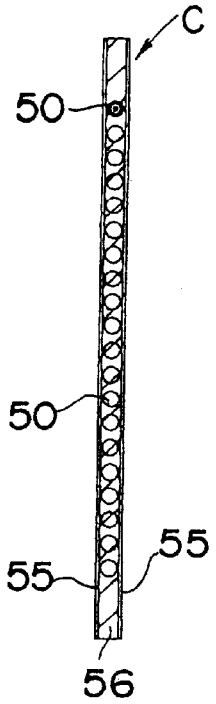
Figure 12:
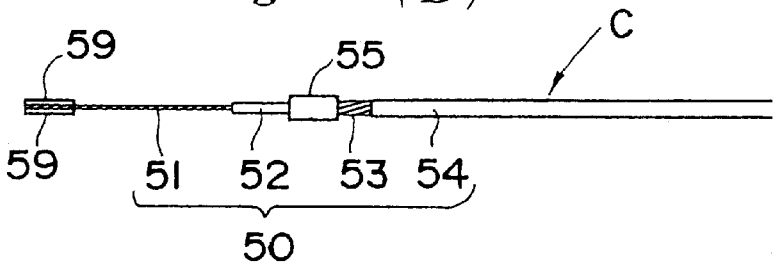

FIG. 9 shows the condition of the plug connector in which the plug retaining member 10 is mounted in the lower cover 20 in a sectional view taken along line IX—IX in FIG. 8. Now, the cable assembly C, which is shown in detail in FIG. 12, is connected to the connection portions 42 of the plug contacts 40 by soldering. The cable assembly C comprises a plurality of coaxial cables 50, which are aligned on a plane and are sandwiched between a pair of upper and lower binding plates 55.

Figure 13:
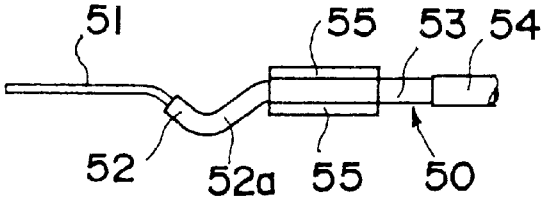
FIG. 13 shows a plan view and an enlarged sectional view of an end portion of the cable assembly.
Figure 13:
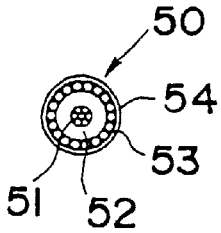

As shown in FIG. 13 (B), each of the coaxial cables 50 comprises an inner conductor (or core wire) 51, which is positioned centrally, an inner insulating layer 52, which surrounds the core wire 51, a braided outer conductor (or shielding layer) 53, which surrounds the inner insulating layer 52, and an outer insulating layer 54, which covers the shielding layer 53. The cable assembly C is assembled by stripping respective layers of each coaxial cable 50 in a stair fashion, by aligning the coaxial cables 50 on a plane, by sandwiching the portions of the coaxial cables 50 where the shielding layers 53 are exposed with the binding plates 55 and by soldering them with a solder 56. Furthermore, the core wires 51, which are positioned at the front end of the cable assembly C, are coated with the solder. Moreover, the front ends of the core wires 51 are sandwiched with laminated films 59 to prevent deformation of the core wires 51 for the purpose of maintaining their relative positions intact. Before the cable assembly C is soldered to the plug connector, the end portions of the core wires 51 are cut away at the position indicated by a chain line Z—Z in the drawing. As shown in FIG. 13 (A), the portions where the inner insulating layers 52 are exposed are bent in a U or V shape so that the coaxial cables are provided with slacks 52*a*.

The cable assembly C, which is assembled as described above and removed of the front end portions of the core wires 51 after being cut at the chain line Z—Z, is now soldered to the plug connector by a pulse heater, as shown in FIG. 9. In this soldering process, at first, the core wires 51, which are exposed at the front end of the cable assembly C, are mounted on the connection portions 42 of the plug contacts 40, which are retained in the plug retaining member 10 (refer to FIG. 10, which shows a sectional view taken along line X—X).

Figure 10:
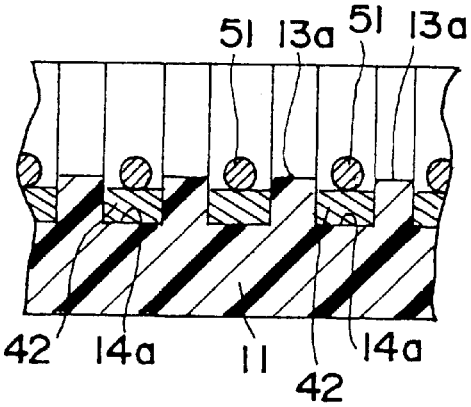
FIG. 10 shows a sectional view taken along line X—X in FIG. 9.

As mentioned previously, the connection portions 42 of the plug contacts 40 are press-fit in the slots 14 of the plug retaining member 10. In this condition, the depth of the slots 14 (i.e., the vertical dimension from an upper end of the slot 14 or from the groove bottom 13*a* of the central groove 13 to the slot bottom 14*a* of the slot 14) is greater than the vertical thickness of the connection portions 42 of the contacts, so the upper surfaces of the connection portions 42 are positioned below the groove bottom 13*a* of the central groove 13. As a result, groove concaves opening upward are formed by the sides of the slots 14 and the upper surfaces of the connection portions 42 as shown in FIG. 10. The core wires 51 are placed into these groove concaves precisely. When the core wires 51 are mounted on the connection portions 42 of the contacts, because the difference between the depth of the slots 14 and the vertical thickness of the connection portions 42 is smaller than the diameter of the core wires 51, the upper tips of the core wires 51 are positioned above the groove bottom 13*a* of the central groove 13 as shown in FIG. 10.

In this condition, where the core wires 51 are mounted on the connection portions 42 of the contacts, the lower surface 5*a* of a heater chip 5 of the pulse heater is lowered and pressed on the core wires 51 to heat the core wires 51 with the heater chip 5 so as to melt the solder coating, which is provided over the core wires 51, and to solder the core wires 51 to the connection portions 42. For this soldering process, the heater chip 5 is designed with a flat lower surface 5*a* which is insertable into the central groove 13 of the plug retaining member 10. Therefore, the lower surface 5*a* is pressed directly onto the core wires 51 only by inserting the heater chip 5 into the central groove 13. This is a simple way which enables the soldering of all the core wires 51 in a single soldering step.

Then, the binding plates 55 of the cable assembly C, whose core wires 51 are soldered to the connection portions 42 of the contacts, are positioned in the rear part of the plug retaining member 10. In other words, the binding plates 55 are mounted over the contact tabs 25 of the lower cover 20 and the central extrusion 15 of the plug retaining member 10, which is in the lower cover 20. In this condition, the binding plates 55 are in contact with the contact tabs 25.

Figure 14:
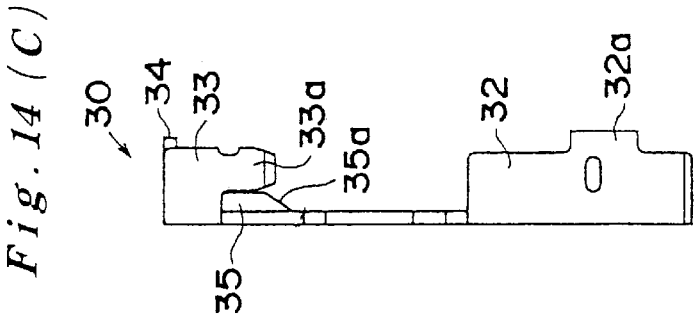
FIG. 14 shows a plan view, a front view and a side view of an upper cover.
Figure 14:
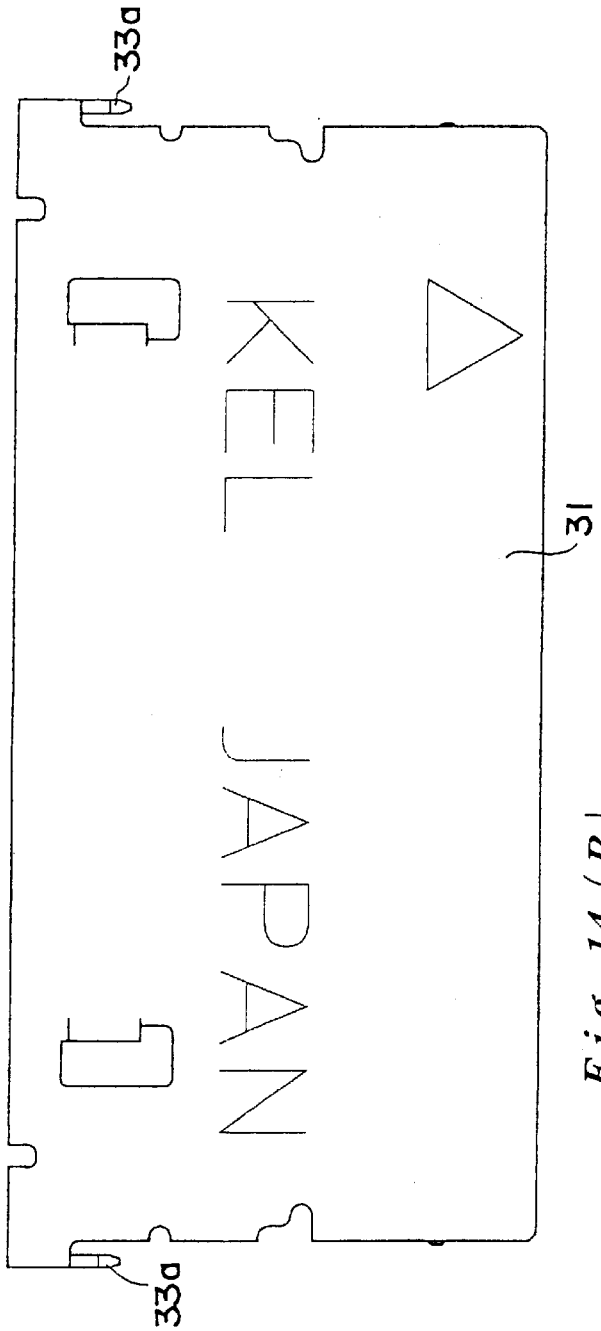
Figure 14:
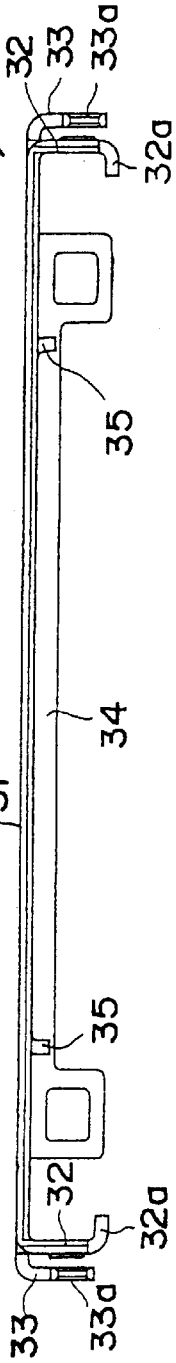

Now, the upper cover 30, which is shown in FIG. 14, is mounted. The upper cover 30 comprises a rectangular flat top portion 31, lateral front side walls 32, rear side walls 33 and a rear wall 34, each of which is bent downward from the top portion 31. Each front side wall 32 includes an engaging portion 32*a*, which is bent inward, and each rear side wall 33 includes an engaging protrusion 33*a*, which protrudes forward. The top portion 31 includes a lateral pair of pressing protrusions 35, which are formed by incising the rear part of the top portion 31 on the right and left sides and by bending the incised portions downward as shown in the drawing. Each pressing protrusion 35 has a taper 35*a* at the front end thereof, which taper is designed to increase the height of the pressing protrusions 35 gradually toward the rear.

This upper cover 30 is placed on the lower cover 20 (which includes the plug retaining member 10 and the cable assembly C) with the front side walls 32 being placed outside the concave portions 22*a* of the lower cover 20, and the upper cover is then slid forward. As a result, the engaging portions 32*a* of the front side walls 32 enter the engagement slots 22*b* of the lateral side walls 22 of the lower cover 20 shown in FIG. 7, so the lower and upper covers 20 and 30 are engaged firmly with each other. At the same time, the engaging protrusions 33*a* of the rear side walls 33 enter the engaging slots (not shown) which are provided in the rear of the plug retaining member 10, so the upper cover 30 and the plug retaining member 10 are also engaged with each other. At this moment, the pressing protrusions 35 being led by the tapers 35*a* come onto the binding plates 55 and press the binding plates 55 downward. In this condition, the binding plates 55 is securely in contact with the pressing protrusions 35 and with the contact tabs 25 of the lower cover 20.

In this way, the plug connector is assembled with the binding plates 55 fixedly retained in the lower and upper covers 20 and 30. In this assembled condition, the slacks 52*a* of the cable assembly C are located between the binding plates 55 and the exposed core wires 51, which are soldered.

This condition prevents any external force acting on the cable assembly C from accidentally affecting the electrical connection of the core wires 51 because such external forces are blocked by the binding plates 55 or absorbed by the slacks 52*a*. Therefore, this plug connector offers a high reliability avoiding any connection failure at the soldered parts.

On the other hand, the receptacle connector R, whose exterior appearance is shown in FIGS. 15 and 16, comprises a plurality of electrically conductive receptacle contacts 70, which are press-fit and aligned in an electrically insulative receptacle retaining member 60 as shown in FIG. 1, which is a sectional view taken along line I—I in FIG. 15. Each receptacle contact 70 has a female contact portion 71, which is shaped like a tuning fork, and a rear lead portion 72, which is used for surface mounting.

The receptacle retaining member 60 is formed by molding as a one body including a main body 61, arms 62, which are provided on the right and left sides of the main body 61, and a central protrusion 61*b*, which extends forward between the right and left arms 62. A plurality of insertion slots 61*a* are provided laterally in the main body 61 to receive and retain the receptacle contacts 70, which are press-fit into the slots, and the insertion slots 61*a* are open at the front end of the central protrusion 61*b*. Therefore, the female contact portions 71 of the receptacle contacts 70 in the insertion slots 61*a* of the main body 61 face the outside through the openings of the central protrusion 61*b* while the lead portions 72 of the receptacle contacts 70 extend in the opposite direction to the outside of the main body 61. An electrically grounding member 80 is provided fittingly in each arm 62, and this grounding member 80 comprises a grounding contact portion 82, which extends from the inside of a respective arm 62 toward the central protrusion 61*b*, and a mounting portion 81, which protrudes rearward from the arm 62. The lower faces of the mounting portions 81 are positioned at the same level as the lower faces of the lead portions 72 of the receptacle contacts 70.

A pair of positioning pins 63 are provided on the rear lower face of the receptacle retaining member 60. These positioning pins 63 are used to position the receptacle connector R on a printed circuit board B as shown in FIG. 1. When the receptacle connector R is mounted on the printed circuit board B, the lower faces of the lead portions 72 of the receptacle contacts 70 and the lower faces of the mounting portions 81 of the grounding members 80 are surface-mounted on electrical pathways which are provided on the printed circuit board B for signal transmission and for grounding, respectively.

The plug connector P and the receptacle connector R, both of which are constructed as described above, are engaged with each other for electrical connection in the direction indicated by an arrow A in FIG. 1. When they are brought into engagement, the plug extrusion 12 retaining the male contact portions 41 of the plug contacts 40 in the slots 12*a* of the plug connector P (i.e., the male contact portions are strengthened by the reinforcing portion) is inserted into the female contact portions 71 of the receptacle contacts 70 of the receptacle connector R. As a result, the female contact portions 71 hold the plug extrusion (or reinforcing portion) 12 together with the male contact portions 41, so the female contact portions 71 and the male contact portions 41 are in contact with each other, establishing the electrical connection between the plug contacts 40 and the receptacle contacts 70. There is no possibility of deformation of the plug contacts 40 during the engagement even though they are thin members because the plug contacts 40 are supported and strengthened by the plate-like plug extrusion 12 and inserted together with the plug extrusion 12 into the female contact portions 71.

Furthermore, when both the connectors P and R are intermated, the right and left front protrusions 16*a* of the plug retaining member 10, which are surrounded by the lower and upper covers 20 and 30 of the plug connector P, are inserted into the spaces located between the right or left arm 62 and the central protrusion 61*b* of the receptacle connector R, respectively, and the external surfaces of the sides of the upper cover 30 of the plug connector P are brought into contact with the grounding contact portions 82 of the grounding members 80 of the receptacle connector R. In this condition, the lower and upper covers 20 and 30 are grounded electrically because the mounting portions 81 of the grounding members 80 are surface-mounted on the grounding pathways of the printed circuit board B. Also, the shielding layer 53 of each coaxial cable 50 is grounded electrically as the binding plates 55 of the cable assembly C are held by and are in contact with the lower and upper covers 20 and 30.

Figure 17:
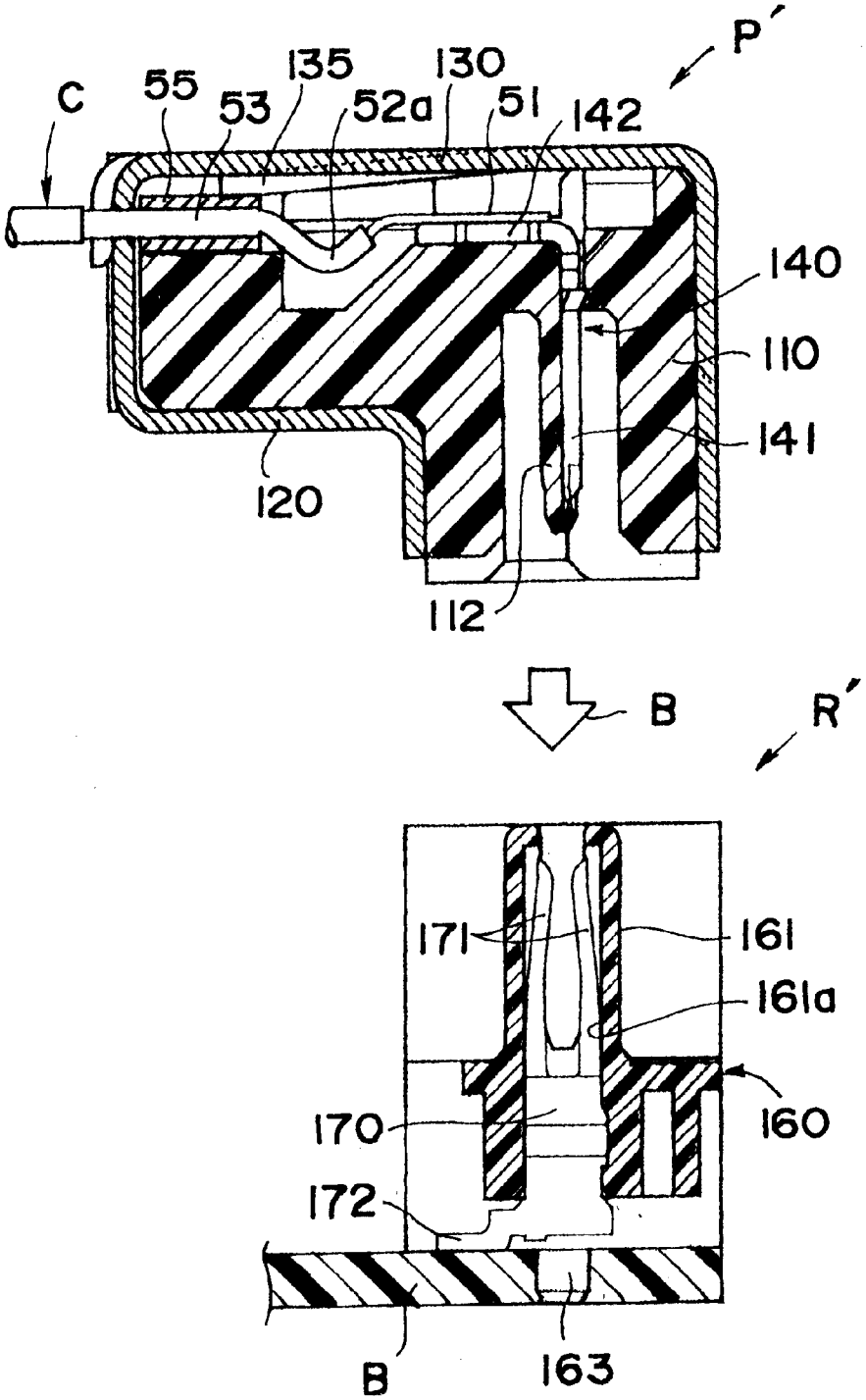
FIG. 17 shows a sectional view of a plug connector and a receptacle connector, which plug connector constitutes another embodiment of cable connector according to the present invention.
Figure 18:
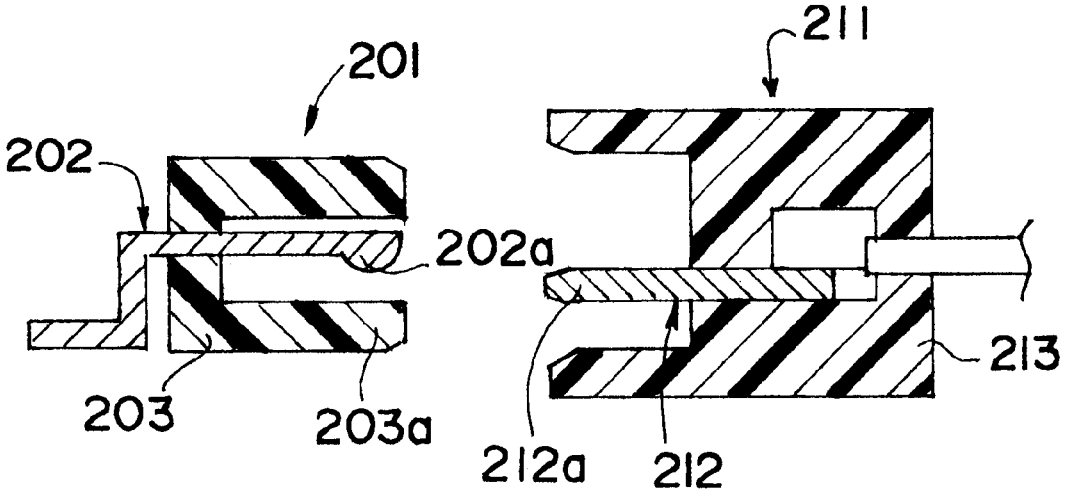
Fig. 18 PRIOR ART
FIG. 18 shows a sectional view of plug and receptacle connectors of prior art.

The cable connector according to the present invention is not limited to the above mentioned embodiment. For example, the present invention can be also embodied in such a construction as shown in FIG. 17. This connector assembly comprises a right-angle type plug connector P' and a receptacle connector R', which is mountable on the printed circuit board B in a upright position. These plug and receptacle connectors are matable with each other in the direction indicated by an arrow B.

The plug connector P' comprises a plurality of plug contacts 140, a plug retaining member 110, which is made of an electrically insulative material and which retains the plug contacts 140 in a lateral alignment, and lower and upper covers 120 and 130, which are made of an electrically conductive material. Each plug contact 140 is bent in a L shape and comprises a male contact portion 141 in the front end thereof and a connection portion 142 in the rear end thereof. The plug retaining member 110 includes a plug extrusion 112, which has an identical construction as the above mentioned embodiment (shown in FIG. 1 through FIG. 16). The plug extrusion 112 receives and retains the male contact portions 141 of the plug contacts 140, which are press-fit into the respective slots of the plug retaining member 110.

The core wires 51 of the cable assembly C are soldered to the connection portions 142, respectively. This soldering connection is rendered in the same way as in the above mentioned embodiment. The core wires 51, which are soldered to the plug contacts 140, the slacks 52*a* and the binding plates 55, which are provided in the cable assembly C, are covered with the lower and upper covers 120 and 130. In this condition, the pressing protrusions 135 of the upper cover 130 are in contact with the binding plates 55.

The receptacle connector R' comprises a plurality of receptacle contacts 170, which are made of an electrically conductive material, and a receptacle retaining member 160, which is made of an electrically insulative material. Each contact 170, which has a shape of tuning fork, comprises a bifurcated female contact portion 171 at the front end thereof and a lead portion 172 at the rear end. The receptacle contacts 170 are press-fit into the insertion slots 161*a* of the receptacle retaining member 160 and aligned and retained in the receptacle retaining member 160. In this condition, the female contact portions 171 of the receptacle contacts 170 face the outside through the openings of the insertion slots

161*a*, which openings are provided at the front end of the central protrusion 161, and the lead portions 172 are surface-mounted on respective electrical pathways which are provided for signal transmission on the printed circuit board B. To position the receptacle connector R' on the printed circuit board B for this surface-mounting, the positioning pins 163 of the receptacle retaining member 160 are inserted into the positioning holes of the printed circuit board B.

Though the following description is not illustrated in figures, the receptacle connector R' further comprises lateral arms, which include a pair of grounding members constructed similarly to those of the receptacle connector R, which are shown in FIGS. 15 and 16. Therefore, when the plug and receptacle connectors P' and R' are engaged with each other in the direction indicated by an arrow B in the drawing, the male contact portions 141, which are retained and strengthened by the plug extrusion 112, are inserted into and held in the female contact portions 171 of the receptacle contacts 170 together with the plug extrusion 112. As a result, the male contact portions 141 are in contact with the female contact portions 171, establishing the electrical connection between the plug contacts 140 and the receptacle contacts 170. In this condition, the external surfaces of the sides of the lower and upper covers 120 and 130 are in contact with the grounding members, which are provided in the arms of the receptacle connector R', so the shielding layers 53 of the cable assembly C are grounded electrically through the binding plates 55, which are in contact with the lower and upper covers 120 and 130.

The fitting portions of the plug connectors P and P' and the receptacle connectors R and R', which are constructed as described above, are configured in identical shapes with identical dimensions, respectively, so they can be mated interchangeably.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 10-242689 filed on Aug. 28, 1998, which is incorporated herein by reference.

What is claimed is:

1. A matching male and female connector assembly comprising:

a first connector which includes a plurality of first contacts and a first retaining member made of an electrically insulative material, each of said first contacts having a female contact portion defined by a pair of resilient arms extending side by side in a tuning fork shape, said first retaining member aligning and retaining said first contacts so that both arms of each pair of resilient arms can resile apart; and a second connector which includes a plurality of second contacts and a second retaining member molded in one piece from an electrically insulative material, said second retaining member aligning and retaining said second contacts, each of said second contacts having a male contact portion and a lower surface which is brought into contact with one arm of each of said female contact portion by insertion of male contact portions into female contact portions;

wherein:

said first connector and said second connector are mated for electrical connection through the insertion of said male contact portions in a forward, mating direction into said female contact portions, respectively;

each of said second contacts is straight and comprises a wire connection portion extending rearward, in straight relation, from said male contact portion and the wire connecting portion having an upper wire connection surface for connection to a wire by soldering;

said second retaining member comprises a vertical portion and a single, reinforcing member which extends from a middle of said vertical portion, straight forward, cantilever fashion continuously along upper surfaces of all said male contact portions of said second contacts retained in said second retaining member, and a wire connection portion supporting member which extends rearward from a bottom of the vertical portion along lower surfaces of all said wire connection portions, opposite to said upper wire connection surfaces and the upper surfaces of the male contact portions to support the wire connection portions during soldering, wherein the second contacts are retained between the reinforcing member and the wire connection portion supporting member and while said first connector and said second connector are being brought into engagement with each other, said male contact portions along with said reinforcing member are inserted as one body into said female contact portions to bring said lower surfaces of said male contact portions into contact with said female contact portions with resilient flexure apart of both arms of each pair of resilient arms of each female contact portion for electrical connection of said first contacts and said second contacts.

2. The matching male and female connector assembly set forth in claim 1 wherein:

said first and second contacts are made of an electrically conductive metallic plate; and said first and second retaining members are formed of a resin by molding.

* * * * *